US006022305A

United States Patent [19]

Choi et al.

[11] Patent Number: 6,022,305

[45] Date of Patent: Feb. 8, 2000

[54] PLEATING APPARATUS

[75] Inventors: Kyung-Ju Choi, Jefferson, County, Ky.; Brian K. Baer, County of Palo Pinto, Tex.

[73] Assignee: AAF International, Louisville, Ky.

[21] Appl. No.: 09/038,744

[22] Filed: Mar. 11, 1998

[51] Int. Cl.[7] ..... B31F 1/20; B31F 1/00

[52] U.S. Cl. ..... 493/463; 493/423; 493/941

[58] Field of Search ..... 493/358, 423, 493/441, 941, 966

[56] References Cited

U.S. PATENT DOCUMENTS

| | | | |
|---|---|---|---|
| 1,348,846 | 8/1920 | Brown et al. . | |
| 2,785,717 | 3/1957 | Knowles | 493/463 |
| 3,321,345 | 5/1967 | Duncan . | |
| 3,809,199 | 5/1974 | Bessier . | |
| 3,959,056 | 5/1976 | Caplan . | |
| 3,993,425 | 11/1976 | Dunn et al. | 493/463 |
| 3,998,140 | 12/1976 | Andre . | |
| 4,045,012 | 8/1977 | Jäkob . | |
| 4,111,733 | 9/1978 | Periers | 493/463 |
| 4,128,678 | 12/1978 | Metcalfe et al. . | |
| 4,736,518 | 4/1988 | Golden et al. . | |
| 4,793,051 | 12/1988 | Golden et al. . | |
| 4,798,575 | 1/1989 | Siversson . | |
| 4,938,739 | 7/1990 | Nilsson | 493/941 |

FOREIGN PATENT DOCUMENTS

| | | | |
|---|---|---|---|
| 917663 | 2/1963 | United Kingdom | 493/463 |

*Primary Examiner*—John Sipos
*Assistant Examiner*—Steven Jensen
*Attorney, Agent, or Firm*—Polster, Lieder, Woodruff & Lucchesi

[57] ABSTRACT

A system for pleating a continuous strip of foldable material including feeding the strip of foldable material between adjacent flights of cooperatively positioned endless conveyors having pleat folding arms pivotally associated therewith which are alternatively and interfittingly positioned to pleat the strip of foldable material as it movingly passes from one end of adjacent flights to the other end thereof.

12 Claims, 4 Drawing Sheets

PLEATING APPARATUS

BACKGROUND OF THE INVENTION

The present invention relates to an apparatus and method for folding at least one continuous sheet of flexible and foldable material and more particularly to an apparatus and method for folding at least one continuous sheet of flexible and foldable filter medium.

It has been long known to use forming machinery to form pleats in at least one continuous sheet of flexible material and particularly to form continuous filter medium sheets with pleat forming apparatus. In this regard, attention is directed to such patents as U.S. Pat. No. 4,798,575, issued to P. E. Siversson on Jan. 17, 1989, wherein a continuous flexible and foldable sheet of material is fed from a feed cell between two cooperative scoring cylinders which respectively include pleat forming scoring blades and cooperatively aligned recesses to score the sheets for pleat formation. Each of the pleat scored sheets is moved to an endless conveyor, sprayed and held in pleated, spaced relation by screw elements as it is fed in a longitudinal direction on the conveyor. In the references cited in the foregoing U.S. Pat. No. 4,798,575—namely, U.S. Pat. No. 1,348,846, issued to G. G. Brown et al. on Aug. 10, 1920; No. 3,321,345, issued to S. F. Duncan on May 23, 1967; No. 3,809,199 issued to P. E. Bessiere on May 7, 1974; No. 3,959,056, issued to H. W. Caplan on May 25, 1976; No. 3,998,140; issued to C. M. Andre on Dec. 21, 1976; No. 4,045,012 issued to H. Jakob on Aug. 30, 1977; and, No. 4,128,678 issued to P. E. Metcalfe et al. on Dec. 5, 1978, comparatively complex systems, including comparatively complex scoring, forming and corrugating machinery and a multiple of pleating steps are utilized to provide finished products of pleated materials. Not only is the disclosed pleating machinery in these patents expensive and complex in assembly, operation and maintenance, but the finished pleated products in many instances would not be suitable for the efficient filtering purposes as is herein intended. Such filtering deficiencies would also accompany the complex pleating arrangements as noted and disclosed in U.S. Pat. No. 4,736,518, issued to P. Golden et al. on Apr. 12, 1988 and in U.S. Pat. No. 4,793,051, issued to P. Golden et al. on Dec. 27, 1988, both of these patents teaching pleating material by the pressure of opposed blade carrying jig supports.

By pleating material, particularly filter medium in the filtering arts, it has been possible to obtain a greater filtering surface exposed to a fluid stream flowing in a given area. However, with past pleating arrangements—such as above described—the material often tears or breaks and fractures and the fracture of material fibers often occurs in the pleating process and in the pleating apparatus associated therewith. Further, these past arrangements which have required several pieces of machinery and several separate steps have been comparatively slow and complex in pleating production, expensive in manufacture and assembly and generally cumbersome to modify for different pleat sizing and spacing geometries.

The present invention provides a pleat forming apparatus and method which is straight-forward and economical to manufacture and assemble, which accomplishes material conveyance and folding simultaneously, which allows for ready adjustment to accommodate for differing pleating geometries and which has comparatively minimal undesirable consequences on the material folded into pleats during conveyance—particularly, past occurring wear and tear on the material being folded and pleated.

Various other features of the present invention will become obvious to one skilled in the art upon reading the disclosure set forth herein.

BRIEF SUMMARY OF THE INVENTION

More particularly the present invention provides apparatus for pleating a longitudinally extending continuous strip of foldable material—such as filter medium—comprising: a longitudinally extending movable conveyor means to receive and convey at least one continuous sheet of foldable material of preselected length in a longitudinally extending path of movement along the conveyor means; power means for the conveyor means; and, a plurality of spaced, parallel pleat folding arm means cooperatively associated with and pivotal with respect to the conveyor means to extend laterally thereacross with at least a portion of each arm means being of preselected breadth and being capable of folding pleats in the foldable material at a preselected angle to the longitudinally extending path of movement of the conveyor means, the arm means being so positioned relative the conveyor means to interfittingly engage in spaced alternative pleat forming relation with opposed faces of the strip of foldable material to hold the pleats thereon in pleated conformation.

In addition, the present invention provides a method of pleating a continuous strip of foldable material such as filter medium—comprising: feeding the strip of foldable material from a supply zone to a pleating zone; and, applying pleat folding pressure at preselected spacings laterally transverse and at preselected angles to opposed faces of the foldable material strip in alternatively spaced increments to provide transversely extending pleats of preselected depth extending substantially across the width of the strip of foldable materials as it is moved through the pleating zone.

It is to be understood that various changes can be made by one skilled in the art in one or more of the several parts of the apparatus and the several steps of the method without departing from the scope or spirit of the present invention. For example, flexible and foldable materials other than filter medium can be foldably pleated in accordance with the invention in more than one layer and in different pleat geometries including pleat crest shapes and pleat angles.

BRIEF DESCRIPTION OF THE DRAWINGS

Referring to the drawings which disclose one advantageous embodiment of the present invention and several modifications thereof.

DETAILED DESCRIPTION OF THE INVENTION

Referring to FIGS. 1–5 of the drawings, one advantageous embodiment of the inventive structure for pleating a longitudinally extending continuous strip 3 of foldable, flexible material is disclosed. It is to be understood that the strip of material 3 advantageously can be a preselected suitable flexible, foldable filter medium which can be folded into pleats in order to maximize the amount of filtering area to be exposed to a fluid stream to be treated in a given space.

Figure 1:
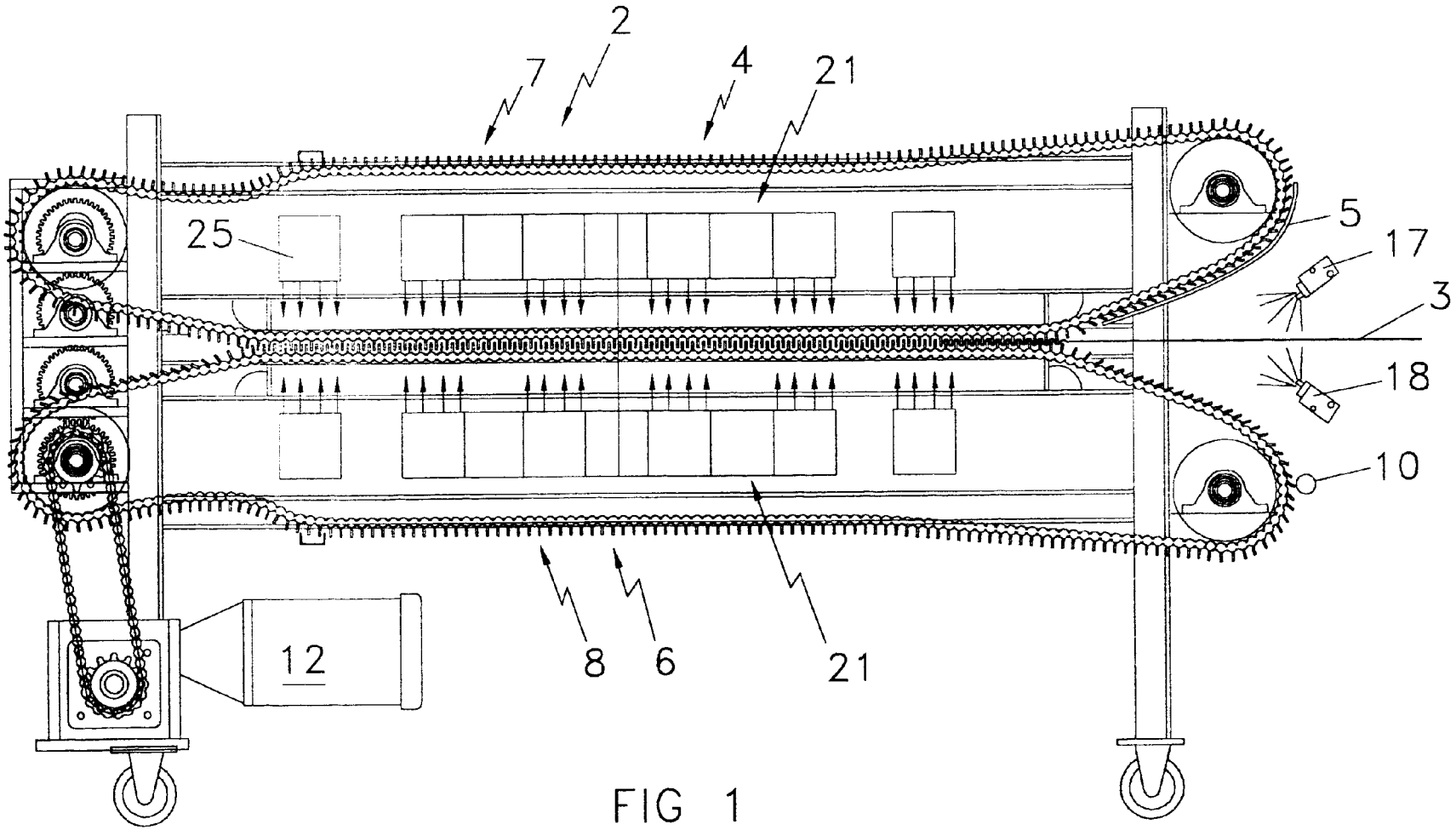
FIG. 1 is an overall side view of the inventive superposed endless conveyor link chains, the power arrangement therefore and the plurality of pleat folding arms pivotally associated with the endless conveyor link chains.
Figure 2:
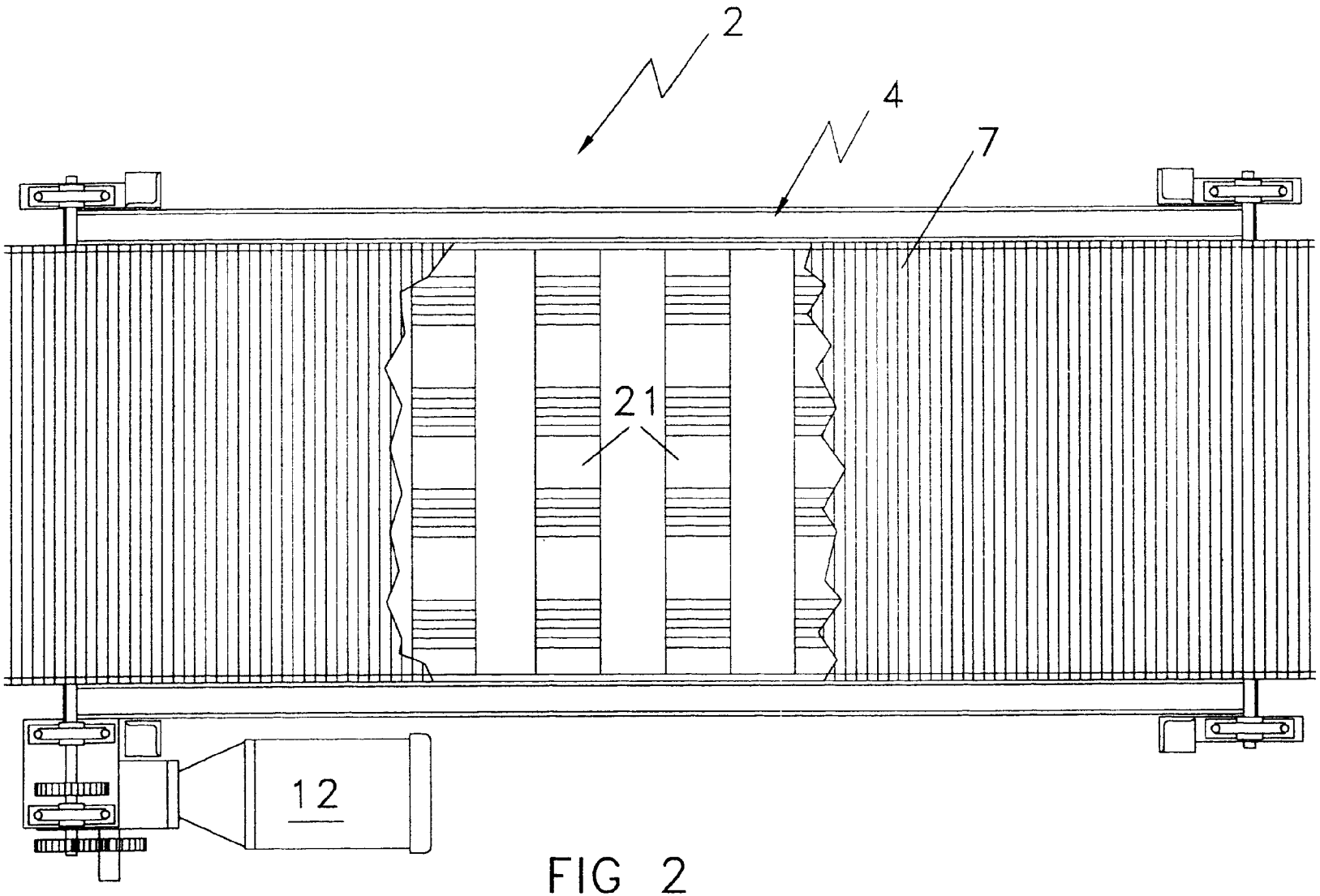
FIG. 2 is a partially broken away top view of the structure of FIG. 1.

As can be more readily understood from FIGS. 1 and 2 of the drawings, the inventive structure includes an upper first pair of horizontally longitudinally extending spaced, parallel opposed endless conveyor link chains 4 spaced from and superposed above a lower second pair of horizontally longitudinally extending spaced parallel endless conveyor link chains 6. It is to be understood that any one of a number of endless conveyor belts and/or link chain mechanisms known in the art can be utilized without departing from the scope of the invention. Further, the length of the conveyors and the spacing between belts of an endless belt pair and the spacing between belt pairs can be varied, as can the positioning of the belts from other than the disclosed horizontal one, can be varied, depending upon the geometry of the material to be folded as well as the limitations of the working area involved.

Pivotally supported between each spaced pair of endless conveyors 4 and 6 are a plurality of upper and lower spaced parallel pleat folding arm sets 7 and 8, respectively. Each set is comprised of a plurality of spaced arms appropriately sized in length and pivotally mounted at opposed arm extremities to extend laterally between and across the spaced endless conveyor link chain belt pairs 4 and 6.

Figure 3:
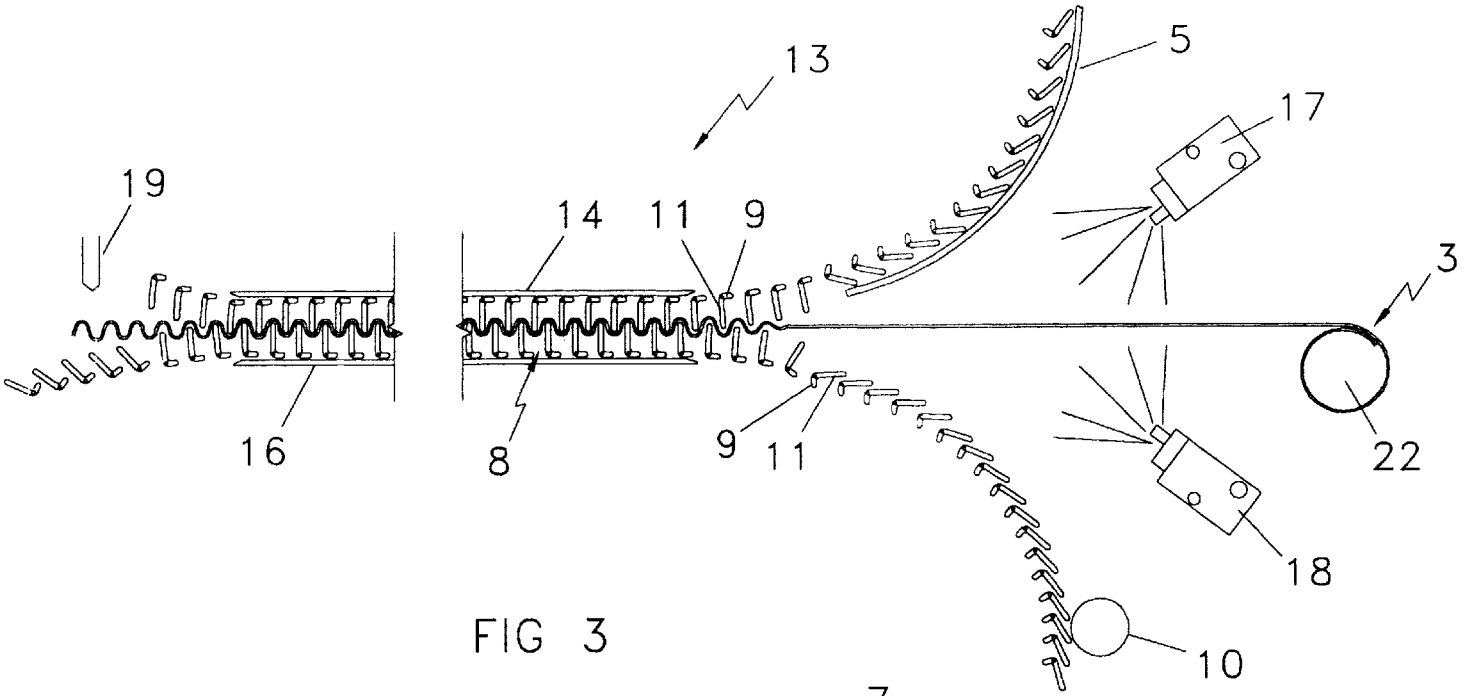
FIG. 3 is an enlarged schematic broken side view of opposed extremities of the inventive structure of FIGS. 1 and 2, illustrating the camming mechanism for the interfitting pleat folding arms pivotally attached to the superposed endless conveyor link chains (shown in FIGS. 1 and 2)
Figure 5:
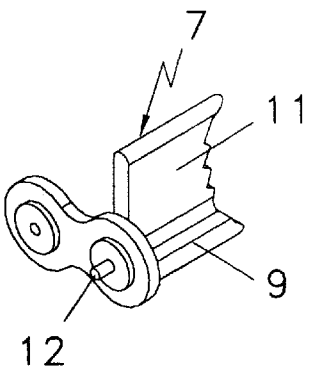
FIG. 5 is an enlarged, schematic, isometric view similar to the view of FIG. 4, further disclosing the pivotal connection of a pleat folding arm to a link of one of the endless conveyor link chains.
Figure 4:
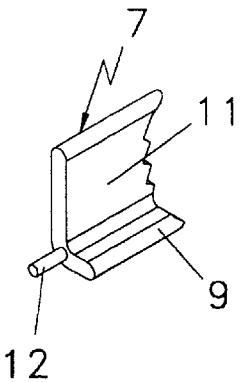
FIG. 4 is an enlarged, schematic, isometric view of an end portion of a pleat folding arm of FIGS. 1–3.

Each of the arms of each set 7 and 8 are of substantially right angle cross-section (FIGS. 4 and 5), to provide longitudinally and laterally extending connected leg sections 9 and 11 forming each arm, as can be seen in FIGS. 4 and 5. At opposed leg section juncture extremities of each arm of each set of arms, chain mounting pivot stubs 12 are fixed, these stubs 12 of each pleat folding arm of each arm set 7 and 8 are mounted and pivotally supported between each spaced pair of endless link-chain conveyors 4 and 6—as above described and as can be seen in FIGS. 1 and 2 of the drawings. As can be more readily seen in FIG. 2 and the schematic drying of FIG. 3, the upper endless conveyor link chain 4 and the lower conveyor link chain 6 are so positioned relative each other that the pleat folding arms of arm set 7 in the lower flight of upper endless conveyor link chains 4 and the pleat folding arms of arm set 8 in the upper flight of lower endless conveyor link-chains 6 spacedly interfit and extend normally to the corresponding lines of movement of the cooperative and opposed lower flight of the upper and the upper flight of the lower pairs of endless link chain conveyors 4 and 6. With respect to the movement of the upper and lower endless conveyor link chains, it is to be noted in FIGS. 1 and 2 of the drawings that a suitable power system 12 including a connecting gear and belt drive arrangement can be provided to appropriately and simultaneously move the adjacent lower and upper flights of endless conveyors 4 and 6 in the same direction so that interfitting pleat folding arms of sets 7 and 8 can engage opposed faces of a continuous strip of foldable, flexible material 3 to fold and pleat the same. It further is to be noted, that a suitable guide strip 5 associated with arm set 7 and guide roll 10 associated with arm set 8 are provided at the entrance end of the material 3 to be folded to assure appropriate interfit of the pleat folding arms of arm sets 7 and 8.

Referring particularly to the schematic drawing of FIG. 3, cam arrangement 13 is schematically disclosed. During endless chain conveyor movement, the disclosed cam arrangement 13 serves to successively and abuttingly engage against each corresponding arm section 9 of each arm of each arm set 7 and 8 to pivotally urge each joined section 11 of each arm of each pleat folding arm set 8 and 7 in the associated upper and lower endless conveyor pairs 6 and 4 into spaced interfitting pleat folding position. Cam arrangement 13 includes two spaced upper and lower horizontally extending cam bars 14 and 16 respectively with upper cam bar 14 and lower cam bar 16 cooperatively and successively engaging against section 9 of each pleat folding arm of each pleat folding arm set 7 and 8, respectively. It is to be noted that the cam arrangement 13 including cam bars 14 and 16 is so positioned with respect to material 3 issuing from a supply roll that sections 11 of the cam bars successively engage against opposed faces of foldable and flexible material as it enters into the lineal moving path of spaced conveyor link chains 4 and 6 to pivot interfitting sections 11 of the arms of arm sets 7 and 8 into normal spaced interfitting parallel relation forming pleat folds into material 3. It also is to be noted that various changes can be made in the sizing and geometry of the arms of arm sets 7 and 8 to vary the pleat depth and relative slope of the pleats and in the area of cam-material engagement without departing from the scope or spirit of the invention. In addition, it is to be noted that if desired the cam bars 14 and 16 can be adjusted in location relative an adjustable feed entrance and the materials being folded and pleated. Further the cam arrangement 13 including cam bars 14 and 16 can be sized in length to extend from entrance to exit of the cooperating endless conveyor link chain pairs 3 and 4 to further insure support of the sections 11 of the pleat folding arm sets 7 and 8 in spaced, erected pleat folding position as they are moved in the lower and upper flights of the conveyor mechanisms.

As can be seen in FIGS. 1 and 3, suitable upper and lower fluid treating spray heads 17 and 18 can be provided at the conveyor entrance and at such other locations as may be desired to treat opposed faces of the material as it is pleat folded. As also can be seen in FIG. 3, a severing mechanism 19—such as a cut off knife blade or laser—can be positioned downstream of the conveyor mechanism to sever the pleated material into desired unit lengths.

As can be seen in the drawings, each of the endless conveyor link chain pairs 4 and 6 can further be provided with appropriately spaced temperature control vents spaced along the length of the conveyor mechanism to selectively cure the folded, pleated material 3 as it is conveyed between the upper and lower flights of the cooperating endless link chain conveyor pairs 4 and 6.

Figure 6:
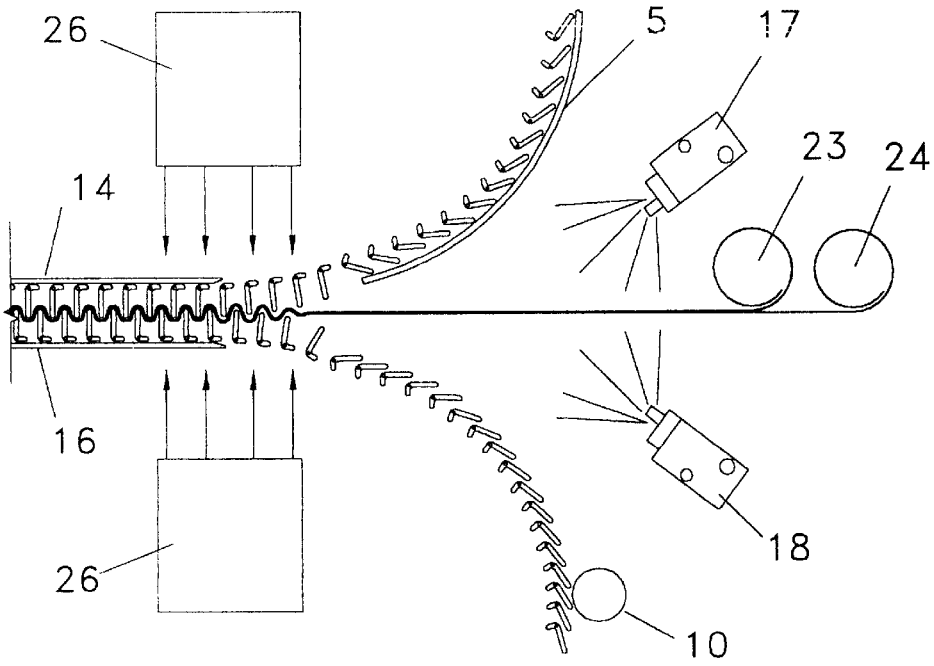
FIG. 6 is an enlarged, schematic broken side view, similar to a portion of the view of FIG. 3, disclosing a modification to the entrance of the inventive structure with two continuous sheets of material being layered and preheated as they are fed into the inventive structure; and, FIG. 7 is an enlarged, schematic broken side view similar to that of FIG. 6, disclosing a further modification wherein three continuous sheets of material are layered, passed through a liquid treating bath, and preheated as they are fed into the inventive structure.

In accordance with the inventive method of the present invention—which can be carried out with the afordescribed inventive apparatus or with some other suitably modified units of apparatus, a continuous strip of flexible, foldable material 3 is fed from a supply zone, such as from the supply roll 22 of FIG. 3. Folding pressure is then applied at preselected spacings laterally transverse and at preselected angles to opposed faces of the flexible foldable material strip in alternatively spaced increments in a pleat folding zone to provide transversely extend pleats of preselected depth substantially across the width of the strip of material as it is moved through the pleat folding zone. The folded, pleated material is then divided in preselected unit lengths in a severing zone. It is to be noted that prior to passing the strip of foldable material to the pleating zone from the supply zone, an adhesive binder can be sprayed on the strip of foldable, flexible material which material can be a preselected filter medium. In a further embodiment of the invention and as can be seen in FIG. 6 of the drawings, flexible, folding material can be fed simultaneously from two supply zones, one of which can be a roll of preselected filter medium 23 and the other of which can be a roll of flexible, foldable thermoplastic supporting material 24 such as plastic netting or some other suitable synthetic or non-woven material. The material comprising a preselected filter medium and a support carrier can be fed from the two supply zones in the form of rolls 23 and 24 as a material in layered form. The layered material can then be sprayed on opposite faces thereof with a suitable adhesive binder in a spray zone by spraying headers 17 and 18 positioned on opposite faces of the layered media. A preheater vent 26, similar to temperature control vents 21, but positioned upstream thereof at the conveyor entrance, can apply heated air, advantageously, in the range of ninety degrees Fahrenheit (90° F.) to three hundred degrees Fahrenheit (300° F.). The specific temperature of the heated air applied depends on the layered material selected but being well below the melting temperature of the support carrier material supplied from roll 24 in order to permit the subsequent pleat folding in the pleat folding zone. In this regard, it is to be noted in FIG. 1 that the furthest downstream temperature control vent 21, or a separate downstream vent 25 can be utilized as a cooling zone in order to set the flexibly formed pleat into rigid pleat form.

Figure 7:
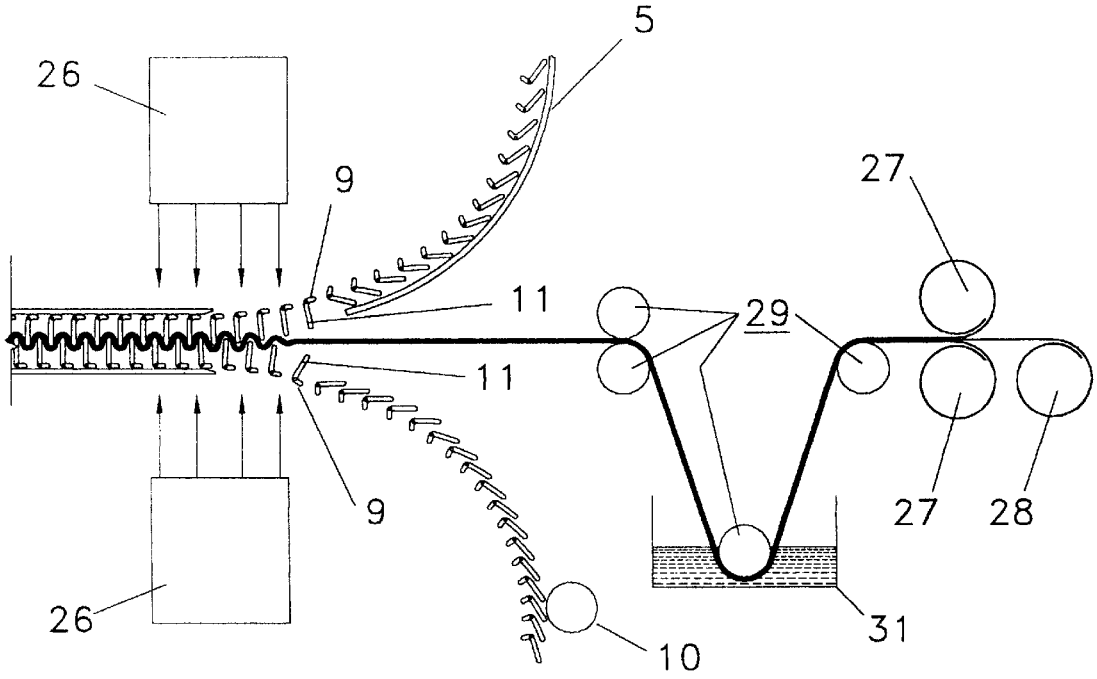

In still another embodiment of the invention, as can be seen in FIG. 7 of the drawings, supporting carriers in the form of two supply rolls 27 can apply layered scrim on either face of a continuously fed sheet of filtering material from filter medium roll 28. Suitable adhesive spraying with an adhesive binder from spray heads 17 and 18 such as shown in FIG. 6 can be utilized, if elected, as can the preheated air from preheater vent. Alternatively, and, as can be seen in this FIG. 7, in place of spray heads, an appropriate guide roll set of selectively spaced guide rolls 29 can be utilized to guide the material through tank 31 for preselected material treatment in a liquid bath contained in tank 31.

The invention claimed is:

1. Apparatus for pleating a longitudinally extending continuous strip of fibrous foldable material comprising: a longitudinally extending movable conveyor means to receive and convey at least one continuous strip of foldable material of preselected length in a longitudinally extending path of movement along said conveyor means; power means for said conveyor means; and, said conveyor means comprising opposed parallel conveyors each having a plurality of longitudinally spaced, parallel pleat folding arm means cooperatively associated with and pivotal with respect to said conveyors to extend laterally thereacross with at least a substantially flat portion of each arm means being of preselected breadth and depth and being pivotally capable of singly folding pleats in said foldable material at a preselected same fold angle to hold each of said pleats in such folded condition substantially along the entirety of the longitudinally extending path of movement of said conveyor means for pleat fold treatment, said arm means of each conveyor being so positioned relative said other conveyor so that only part of the depth of said arms interfit and continuously engage in spaced alternative pleat forming relation with opposed faces of said strip of foldable material to singly fold and hold said pleats therein continuously in said fold angle and in the same preselected pleated conformation of said strip of foldable material as a consequence of said single folding; and means to maintain said pleat folding arm means in said interfittingly engaged fold position consistently and continuously in preselected position without further fold interruption along substantially the entirety of said longitudinally extending path of movement of said conveyor means with the longitudinal spacing of said folds permitting further preselected fluid pleat treatment of the material strip as it is moved along said conveyor means path.

2. The pleating apparatus of claim 1, said conveyors and associated pleat folding arm means comprising at least two rows of opposed, spaced flights positioned with associated and pivotal pleat folding arm means to be in spaced interfitting relationship to feed a foldable material strip to be folded and pleated therebetween.

3. The pleating apparatus of claim 2, said rows of spaced flights comprising adjacent parallel flights of cooperatively spaced, parallel and associated endless belt conveyors pairs.

4. The pleating apparatus of claim 1, each laterally extending pleat folding arm means being of substantially right angle, cross-section and pivotally connected to said conveyors so that one section of each arm means can be pivotally urged to extend normally to said longitudinally extending path of movement of said conveyor means.

5. The pleating apparatus of claim 4, said means to maintain said arm means in continuous interfittingly fold engaged position including longitudinally extending adjustable camming bars preselectively positioned to extend substantially continuously along the entirety of said conveyor means to pivotally urge said one section of each laterally extending arm means to extend normally to said longitudinally extending path of movement of said conveyor means.

6. The pleating apparatus of claim 4, and guide means associated with said conveyor means and said arm means to assure proper interfit positioning of said arm means.

7. The pleating apparatus of claim 1, and adhesive binder applicator means positioned upstream of said conveyor means to apply a preselected adhesive binder to said continuous strip of flexible foldable material.

8. The pleating apparatus of claim 7, said adhesive binder applicator means including adhesive binder spray heads to apply adhesive binder on opposite faces of said strip of foldable material.

9. The pleating apparatus of claim 7, said adhesive binder applicator means including a liquid tank containing a liquid bath to apply adhesive binder of opposite faces of said strip of foldable material.

10. The pleating apparatus of claim 7, and temperature control means positioned downstream said adhesive binder applicator and extending along substantially the entirety of said longitudinally extending path of movement of said conveyor means to cure adhesive binder applied to said continuously engaged single folded material.

11. The pleating apparatus of claim 10, said temperature control means including forced air heating vents positioned intermediate the extremities of said conveyor means to apply heated air to said adhesive binder treated foldable material.

12. The pleating apparatus of claim 11, said continuous strip of foldable fibrous material comprising a plurality of sheets of preselected material and said temperature controls including preheating forced air vents upstream said forced air heating vents and cooling means positioned downstream said forced air heating vents.

* * * * *